United States Patent [19]

Nelson

[11] 4,162,739

[45] Jul. 31, 1979

[54] LABEL DISPENSER

[76] Inventor: Harlan I. Nelson, 1103 N. Springbrook Ave., Newburg, Oreg. 97132

[21] Appl. No.: 828,342

[22] Filed: Aug. 29, 1977

[51] Int. Cl.[2] ..... B65H 5/28

[52] U.S. Cl. ..... 221/70

[58] Field of Search ..... 221/70, 71–74; 242/55.3, 55.53, 71.1; 225/52

[56] References Cited

U.S. PATENT DOCUMENTS

| | | | |
|---|---|---|---|
| 2,500,012 | 3/1950 | Smoak | 225/52 X |
| 2,613,879 | 10/1952 | Carr, Jr. | 225/52 X |
| 3,040,943 | 6/1962 | Bump | 225/52 |
| 3,698,600 | 10/1972 | Foote | 221/73 X |

*Primary Examiner*—Stanley H. Tollberg
*Attorney, Agent, or Firm*—Oliver D. Olson

[57] ABSTRACT

A label dispenser for dispensing adhesive labels from rolls of label tape, comprises a rectangular enclosure having a plurality of adjustable-width partitions for holding variable width label tape rolls in an upright position, and a hinged lid which can be opened to insert fresh tape rolls. The free ends of the label tapes are fed through a pair of sponge rubber strips, mounted, respectively, at the upper edge of the enclosure front wall and the forwardmost portion of the lid for mutual contact when the lid is closed. A hasp-type lid fastener serves to draw the lid downwardly, compressing the two rubber strips together, whereby to grip the label tapes frictionally between them when the lid is fastened shut.

3 Claims, 3 Drawing Figures

LABEL DISPENSER

BACKGROUND OF THE INVENTION

This invention relates to label dispensers, and more particularly to a dispenser by which to dispense a plurality of labels of diverse sizes.

In preparing packaged goods for retail display, it is often desirable to affix to the packaged goods labels which identify the product as to special feature or price. Particularly in packaging cuts of meat for display in supermarket meat cases, it is a common practice to identify the particular cuts of meat with labels adhesively attached to the meat packages. Such labels are conventionally supplied on rolls of label tape consisting of a plurality of labels adhesively attached to an elongated backing strip at longitudinally spaced intervals. Heretofore, labels so supplied have been dispensed from loosely held rolls, and removing labels from the rolls has required that the rolls be held in one hand and the labels peeled off the backing strip with the other hand. This method of dispensing adhesive labels is unduly cumbersome, in that it requires the use of both hands.

Prior methods also have resulted in tangling of tape rolls and consequent creasing, tearing, or otherwise damaging the labels.

SUMMARY OF THE INVENTION

In its basic concept, the label dispenser of the present invention comprises a rectangular enclosure having a plurality of adjustable-width partitions for spacing apart a plurality of variable width label tape rolls in an upright position, the ends of the label tapes being held between friction strips as they are pulled outwardly during dispensing.

It is by virtue of the foregoing basic concept that the principle objective of this invention is achieved; namely, to overcome the disadvantages and limitations of prior label dispensing procedures.

Another object of the present invention is to provide a simple, inexpensive device for dispensing labels supplied in rolls of label tape, which tape consists of labels adhesively attached to a backing strip.

It is another object of this invention to provide a label dispenser which accommodates a plurality of label tape rolls of varying widths.

A further object of this invention is to provide a label dispenser of the class described in which means is provided for maintaining laterally spaced tape rolls separated from each other.

A still further object of this present invention is to provide a label dispenser of the class described which accommodates the interlocking of a plurality of said dispensers in a stacked vertical arrangement.

The foregoing and other objects and advantages of this invention will appear from the following detailed description taken in connection with the accompanying drawing of a preferred embodiment.

DESCRIPTION OF THE PREFERRED EMBODIMENT

Figure 1:
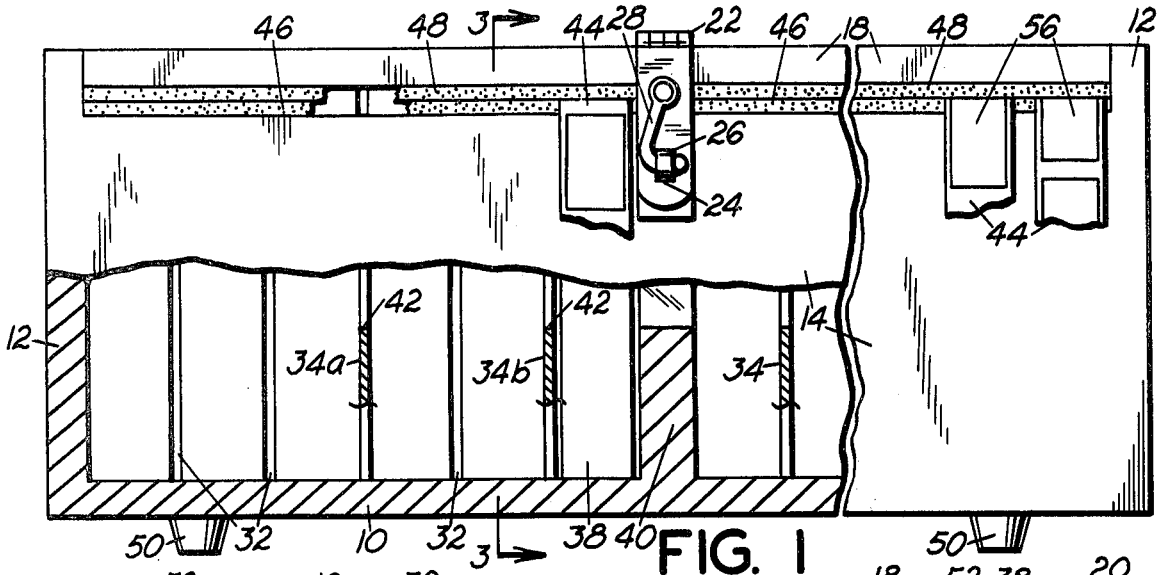
FIG. 1 is a foreshortened front elevation, partially cut away, of the label dispenser embodying the features of this invention.
Figure 2:
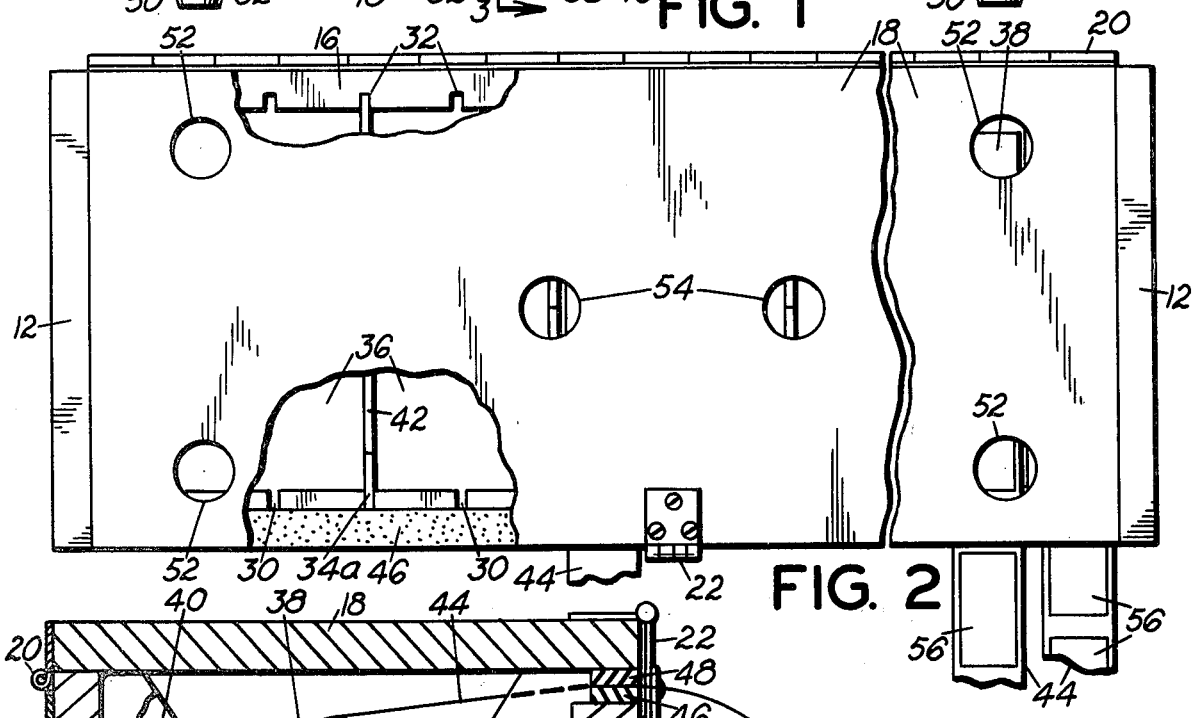
FIG. 2 is a foreshortened plan view, partially cut away of the label dispenser shown in FIG. 1.

Referring to the drawing, the tape dispenser comprises a rectangular enclosure having a bottom 10, a pair of side walls 12, a front wall 14, and a rear wall 16 and a lid 18. The lid is pivotally attached to the upper end of the rear wall by hinge 70 and is releasably secured to the front wall 14 by fastener means which, in the embodiment illustrated, comprises a hinged hasp 22 that is secured to the lid and has an opening 24 for receiving a staple 26 mounted on the front wall of the enclosure. The hasp and staple are secured together releasably by a hook 28 pivoted to the hasp.

The interior faces of the front and rear walls 14 and 16 are provided with a plurality of pairs of aligned grooves 30 and 32 spaced apart laterally at regular intervals along these walls. These pairs of grooves support a plurality of removable dividers 34 which partition the enclosure into vertical pockets 36 in which tape rolls 38 are to be housed. The spacing between adjacent grooves 30 in front wall 14 and 32 in rear wall 16 is slightly greater than the width of a standard size tape roll, so that the dividers supported in adjacent pairs of grooves 30 and 32 form the side walls of a pocket which houses a standard width tape roll.

Tape rolls having greater widths, e.g. twice or three times the standard width, are likewise housed in pockets in which the dividers are two or three grooves removed, respectively. This is illustrated in FIG. 1. The first divider 34*a* forms a three-groove slot with the left side wall 12, the second divider 34*b* forms a two-groove slot with the first divider 34*a*, and a one-groove slot with the center spacer 40.

The width of the center spacer 40 corresponds to the width of the hasp 22, insuring that the hasp does not interfere with the label tape in the two centermost tape slots when the lid is fastened shut.

A V-shaped cutout 42 in each divider allows access to the tape rolls in the pockets 36 to facilitate their removal by hand.

Figure 3:
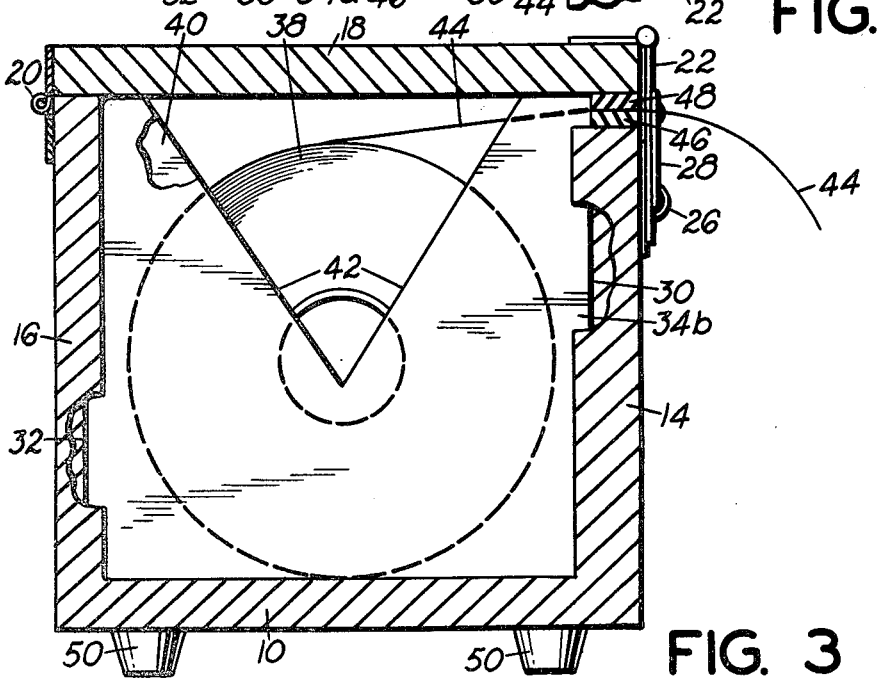
FIG. 3 is a sectional view taken along line 3—3 of FIG. 1.

The free ends 44 of the label tapes are fed through a pair of sponge rubber or other suitable friction strips 46 and 48 at the front of the dispenser. These strips are compressed when the lid is fastened shut to slidably grip the label tape between them. The lower strip 46 is mounted on the upper edge of the front wall, covering the ungrooved rectangular area on the upper front wall edge, i.e. forwardly of the groove 30. The upper strip 48 is mounted on the forwardmost region of the interior face of the lid. The mutually contracting surfaces of the two rubber strips overlap when the lid is closed, as illustrated in FIGS. 1 and 3.

The strips 46 and 48 are disposed forwardly of the grooves 30 to permit removal and illustration of the dividers 34. The forward portions of the dividers extend upwardly beyond the upper face of strip 46, so as to provide lateral barriers to the free ends of the tapes, whereby to prevent the latter from overlapping one another and becoming tangled, or otherwise creasing or damaging the labels.

The hasp 22 attached to the lid engages the looped staple 26 mounted on the front wall of the dispenser to fasten the lid shut. The vertical position of the staple 26 relative to the hasp 22 is such that, in order for the hasp to engage the staple the lid must be pushed downward slightly, compressing the two sponge rubber strips 46 and 48. Viewed in another way, the act of forcibly engaging the hasp with the curved lower edge of the staple 26 draws the lid downwardly, compressing the two rubber strips. To secure the hasp 22 in fastening position, the hasp hook 28 is pushed into the staple loop, as shown in the figures.

The dispenser is provided with four soft rubber friction foot pads 50 arranged near the corners of the enclosure bottom. These foot pads serve to secure the dispenser on a smooth table or counter top against displacement during the label-dispensing operation. Positioned directly above the four foot pads are four nesting sockets 52 drilled in the enclosure lid. These sockets are designed to receive the foot pads 50 of a second label dispenser. Two or more dispenser units thus can be stacked vertically to form a multi-unit label dispenser.

Each label dispenser also has a pair of finger holes 54 drilled in the dispenser lid for holding the dispenser when carrying.

The operation of the label dispenser will now be described with reference to the drawing. The dispenser is adapted to support a plurality of label tape rolls 38 by insertion of the dividers 34 in the pairs of grooves 30 and 32 lateral groove intervals corresponding to the width and number of the tape pockets desired. The tape rolls are placed in the appropriate pockets with the free ends of the label tapes issuing from the tops of the rolls, as shown in FIG. 3. The free ends 44 of the tapes are drawn over the lower friction strip 46, exposing one or more adhesively-attached labels 56 at the front of the enclosure. The lid is then closed. By further pushing the lid downwardly, and thereby compressing the two rubber strips, the hasp opening 24 is brought into vertical alignment with the staple 26. The hasp opening then is passed over the stple and secured by drawing the hasp hook 28 through the staple loop. It is understood that the compressing of the two rubber strips which is necessary to engage the hasp opening with the staple 26 can be accomplished either by pushing the lid downwardly, or by forcibly passing the hasp opening over the staple, or by a combination of these two forces.

When the lid is thus fastened shut, the two sponge rubber strips are held under moderate compression, slidably but frictionally gripping the label tape therebetween. The gripping contact between the rubber strips 32 and 34 and the lower and upper faces of the label tape serves to prevent the label tape from advancing when the adhesive labels are peeled off the backing strip; at the same time, the label tape is sufficiently slidable between the rubber strips that the tape may be advanced forwardly without dislodging the dispenser from its position on a horizontal supporting surface. The adhesive labels can thus be removed and the label tape advanced by a one-hand operation.

It can be appreciated from the foregoing description that numerous changes in the size, shape, type, number and arrangement of parts described herein may be made without departing from the spirit of this invention.

Having now described my invention and the manner in which it may be used, I claim:

1. A label dispenser for dispensing adhesive labels from rolls of label tape, comprising:

(a) an enclosure having bottom, side, rear and front walls and a hinged lid, (b) a plurality of laterally spaced divider walls in the enclosure which partition the enclosure laterally into a plurality of laterally spaced pockets for freely receiving rolls of label tape, (c) first and second compressible friction strips attached, respectively, to the enclosure front wall and to the lid, which strips are mutually contacting when the lid is closed, and (d) interengageable fastener means on the lid and front wall arranged for interengagement when the first and second compressible friction strips are compressed together beyond said condition of mutual contact, whereby to frictionally grip label tape slidably between them.

2. A label dispenser for dispensing adhesive labels from rolls of label tape, comprising:

(a) an enclosure having bottom, side, rear and front walls and a hinged lid, (b) a plurality of dividers in the enclosure which partition the enclosure laterally into a plurality of laterally spaced pockets, (c) first and second compressible friction strips attached, respectively, to the enclosure front wall and to the lid, which strips are mutually contacting when the lid is closed, for slidably gripping therebetween the ends of label tape extending outward between said strips, (d) fastener means for fastening the lid shut, and (e) interengaging means on the bottom wall and lid for releasably interlocking a plurality of said dispensers in a stacked vertical arrangement.

3. A label dispenser for dispensing adhesive labels from rolls of label tape, comprising:

(a) an enclosure having bottom, side, rear and front walls and a hinged lid, (b) a plurality of dividers in the enclosure which partition the enclosure laterally into a plurality of laterally spaced pockets, (c) first and second compressible friction strips attached respectively, to the enclosure front wall and to the lid, which strips are mutually contacting when the lid is closed, for slidably gripping therebetween the ends of label tape extending outward between said strips, (d) fastener means for fastening the lid shut.

(e) a plurality of foot pads attached to the bottom surface of the dispenser for securing the dispenser on a supporting surface, and (f) a plurality of nesting sockets in the dispenser lid, vertically aligned with said foot pads, for receiving the foot pads of a second identical dispenser, whereby a plurality of said label dispensers may be supported in a stacked vertical arrangement.

* * * * *